United States Patent [19]

Goloff et al.

[11] 3,972,658

[45] Aug. 3, 1976

[54] HOUSING FOR SLANT AXIS ROTARY MECHANISM

[75] Inventors: Alexander Goloff, East Peoria; Noble G. Barker, Pekin, both of Ill.

[73] Assignee: Caterpillar Tractor Co., Peoria, Ill.

[22] Filed: Nov. 12, 1975

[21] Appl. No.: 631,025

[52] U.S. Cl. ..... 418/53

[51] Int. Cl.[2] ..... F01C 1/02

[58] Field of Search ..... 418/49, 50, 51, 52, 418/53

[56] References Cited

UNITED STATES PATENTS

| | | | |
|---|---|---|---|
| 455,061 | 6/1891 | Shaw | 418/51 |
| 599,494 | 2/1898 | Dodge | 418/53 |
| 1,638,183 | 8/1927 | Bylger | 418/53 X |
| 3,485,218 | 12/1969 | Clarke | 418/53 |

*Primary Examiner*—C. J. Husar
*Assistant Examiner*—Leonard Smith
*Attorney, Agent, or Firm*—Wegner, Stellman, McCord, Wiles & Wood

[57] ABSTRACT

An improved slant axis rotary mechanism such as an engine, pump, or the like. The same includes a housing defining an operating chamber having a radially outer spherical surface, a radially inner spherical surface, and opposed end surfaces extending between the spherical surfaces. The housing includes half shells carrying the outer spherical surface, each of which has spaced, radially inwardly opening grooves flanking the outer spherical surface. The housing also includes a pair of end wall members, each carrying one of the end surfaces and part of the inner spherical surface and the periphery of the end wall members is disposed in a corresponding one of the grooves in the half shells. Means are provided for securing the half shells together. A shaft is journalled in the end wall members and has an angularly offset portion within the chamber. A rotor having a peripheral flange within the chamber is journalled on the angularly offset portion. The end surfaces are curved and the sides of the rotor flange are curved to match the curve of the end surfaces.

8 Claims, 5 Drawing Figures

HOUSING FOR SLANT AXIS ROTARY MECHANISM

BACKGROUND OF THE INVENTION

This invention relates to slant axis rotary mechanisms, and, more particularly, to such mechanisms employed as engines, compressors, pumps, or the like.

The most pertinent prior art known to the applicant includes U.S. Pat. No. 3,485,218 issued on Dec. 23, 1969 to J. M. Clarke.

Existing slant axis rotary mechanisms employ housings having circumferential splits dividing the housing or casing into front and rear sections. Peripheral seals disposed on a rotor within an operating chamber defined by the housing casings, travel in a path wherein they intersect the split line at a very small angle which is not conducive to the building of a good oil film to provide adequate lubrication.

Moreover, circumferential splitting of the housing does not allow the surfaces defining the operating chamber to be machined such that the machining marks run in a direction other than substantially about the circumference. Again, seals carried by the rotor intersect the machining marks at very small angles which is not conducive to the building of a good oil film necessary to provide adequate lubrication.

In addition, the approach employed to date is not conducive to the provision of sharp corners at the intersection of the radially outer spherical surface and the end surfaces of the operating chamber. Thus, adequate sealing in the region of such corners is difficult to achieve.

In addition, the end walls of such mechanisms have heretofore been made straight from the radially inner point to the radially outer point when viewed in cross section about the entire end surface. At the same time, the mating surfaces of the rotor flange have similarly been made straight. As a consequence, considerable deflection exists during operation requiring that the rotor be made smaller than its theoretical size to avoid interference between the rotor and the housing during operation due to such deflections. As a consequence, the compression ratio or volumetric efficiency of the mechanism is reduced.

SUMMARY OF THE INVENTION

It is the principal object of the invention to provide a new and improved slant axis rotary mechanism for use as an engine, pump, compressor, or the like. More specifically, it is an object of the invention to provide such a mechanism wherein the housing may be formed to eliminate lubricating problems and wherein deflection is minimized to improve the compression ratio or volumetric efficiency of the mechanism.

An exemplary embodiment of the invention achieves the object of improving the housing to obtain adequate lubrication in a structure including a housing defining an operating chamber having a radially outer spherical surface, a radially inner spherical surface, and opposed spaced end surfaces extending between the spherical surfaces. The housing includes shell means carrying the outer spherical surface and having spaced radially inwardly opening grooves flanking the outer spherical surface. The housing is completed by a pair of end wall members, each carrying one of the end surfaces and a part of the inner spherical surfaces. The peripheries of the end wall members are disposed in corresponding ones of the grooves. A shaft is journalled in the end wall members and has an angularly offset portion within the chamber and a rotor is journalled on the angularly offset portion within the chamber.

According to a highly preferred embodiment, the shell means are defined by two half shells and means are provided for securing the half shells together. As a consequence, the elements may be machined in a direction generally transverse to the circumferential direction. Thus, seals carried by the rotor run at large angles relative to machine marks and the splits to promote excellent lubrication.

The object of overcoming excessive deflection is achieved in an exemplary embodiment of the invention wherein the end walls are curved in a direction from the radially inner point to the radially outer point, as viewed in section, and corresponding curves are placed in the sides of the rotor flange. The curving of the surfaces subjected to gas under pressure provides greatly improved resistance to deflection.

According to one embodiment of the invention, the curved end walls are convex, while the sides of the rotor flange are concave.

According to another embodiment of the invention, the converse configuration is employed.

Other objects and advantages will become apparent from the following specification taken in connection with the accompanying drawings.

DESCRIPTION OF THE PREFERRED EMBODIMENTS

Figure 1:
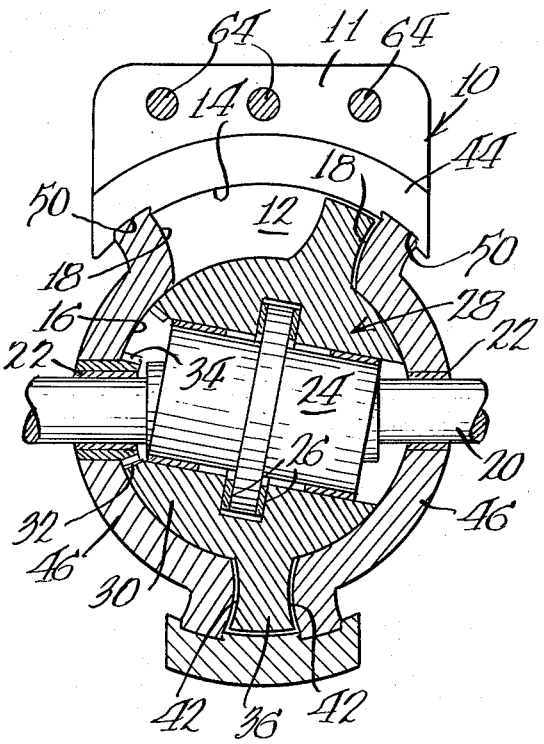
FIG. 1 is a sectional view of a slant axis rotary mechanism made according to the invention.

An exemplary embodiment of a slant axis rotary mechanism made according to the invention is illustrated in FIG. 1 and is seen to include a housing, generally designated 10, defining an operating chamber 12. The operating chamber 12 is bounded by a radially outer spherical surface 14, a radially inner spherical surface 16, and opposed, spaced end surfaces 18 extending between the spherical surfaces 14 and 16.

A shaft 20 is journalled by means of bearings 22 in the housing and includes an angularly offset portion 24 within the operating chamber 12. Suitable bearings 26 on the angularly offset portion journal a rotor, generally designated 28, within the operating chamber.

The rotor 28 includes a spherical hub 30 and, by means of seals, not shown, is sealed against the radially inner spherical surface 16. At one end of the hub 30, there is disposed an internal ring gear 32 which is engaged with a stationary gear 34 carried by the housing to establish a desired timed relationship between rotation of the shaft 20 and the rotor 30. For example, if the mechanism is a four-cycle mechanism, the gearing will be such that the rotor 30 will complete one revolution for each three revolutions of the shaft 20.

Figure 3:
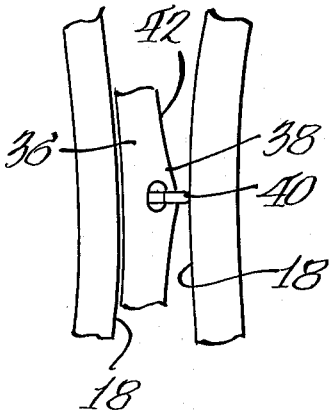
FIG. 3 is a fragmentary developed view of housing parts and the rotor.

The rotor 28 includes a peripheral flange 36 which has plural apices on each side thereof. One such apex 38 is illustrated in FIG. 3 and the same, by means of a groove, carries an apex seal 40 which is biased into engagement with the adjacent end surface 18. The number of apices on each side of the flange 36 will, of course, vary depending upon the particular mechanism. If the mechanism is a two-cycle mechanism, there will be two such apices 38 on each side of the flange, while if the mechanism is a four-cycle mechanism, there will be three apices 38 on each side of the flange 36. Of course, an apex seal 40 will be located at each apex.

Figure 4:
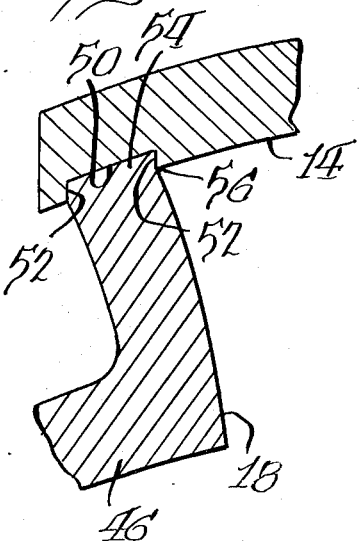
FIG. 4 is an enlarged, fragmentary view of one embodiment of the invention.

In order to resist deflection, the invention contemplates that the end surfaces 18 be curved as viewed in cross section, such as is seen in FIG. 1. Specifically, FIGS. 1 and 4 show one such arrangement wherein the end surfaces 18 are convex. The sides 42 of the rotor flange 36 are provided with a corresponding curve and, in the embodiment of FIGS. 1 and 4, are concave. Consequently, improved resistance to deflection in both the end surfaces 18 and the rotor flange 36 is achieved. Of course, the apex seals 40 will have curved surfaces conforming to the curve of the end surface 18.

Figure 5:
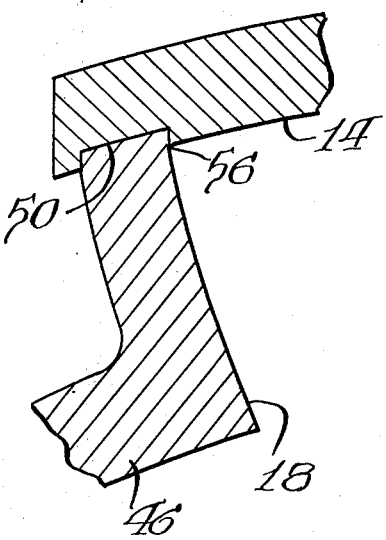
FIG. 5 is an enlarged, fragmentary view of another embodiment of the invention.

FIG. 5 illustrates an alternative embodiment wherein the end surfaces 18 are also curved, but in a convex configuration. In the embodiment of FIG. 5, the flange sides 42 are convex.

The particular curve employed need not be uniform. That is, from a radially inner position to a radially outer position on each end surface 18, the radius of the curve need not be uniform.

Figure 2:
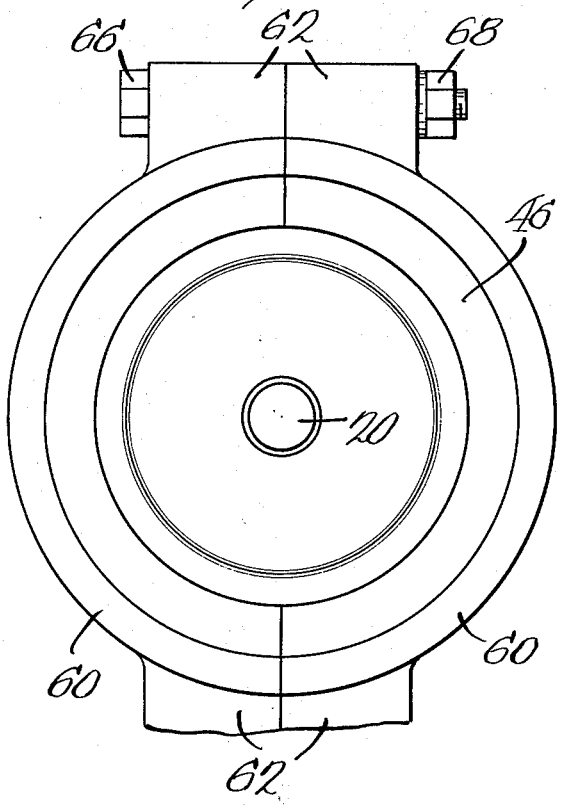
FIG. 2 is an elevation of the mechanism.

FIGS. 1, 2 and 4 also show an improved housing structure for the mechanism. Specifically, the housing 10 is defined by a shell 44 and carrying the radially outer spherical surface 14. The housing 10 also includes a pair of end wall members 46. Each end wall member 46 carries one of the end surfaces 18 as well as a part of the radially inner spherical surface 16. The shell 44 is provided with generally radially, inwardly opening grooves 50 which flank the radially outer spherical surface 14 and which receive the peripheries of respective ones of the end wall members 46.

As best seen in FIG. 4, it is preferred that the side walls 52 of the grooves 50 lie in planes substantially transverse to the longitudinal axis of the shaft 20. At the same time, each of the end wall members 46 is provided with a peripheral tongue 54 which is generally transverse to the longitudinal axis of the shaft 20 to be received in the groove 50. This feature simplifies assembly of the mechanism. It will also be appreciated that the arrangement provides for an extremely sharp corner at the intersection of the end surfaces 18 and the radially outer spherical surfaces 14, as illustrated at 56 in both FIGS. 4 and 5. Consequently, improved sealing results.

In a highly preferred embodiment of the invention, to ease assembly problems, the shell 44 is split into two half shells 60. Flanges 62 are located at each end of each shell 60 and include aligned apertures 64 therein for receipt of bolts 66 which may be fastened in place by means of nuts 68. As a consequence, the split lines will be generally transverse to the circumferential movement of the rotor 28 and the seals carried thereon to provide for good lubrication. It will also be appreciated that by fabricating the housing 10 in the manner described above, the various surfaces may be machined in such a way that the machine marks will extend at a substantial angle to the circumferential direction to also enhance lubrication.

What is claimed is:

1. A slant axis rotary mechanism comprising:

a housing defining an operating chamber having a radially outer spherical surface, a radially inner spherical surface and spaced opposed end surfaces extending between said spherical surfaces, said end surfaces being curved;

a shaft journalled in said housing and having an angularly offset portion within said chamber;

a rotor journalled on said angularly offset portion within said chamber, said rotor having a peripheral flange with plural apices on each side thereof, the sides of said flange being curved to match the curve of said end surfaces; and a plurality of apex seals, one at each said apex, carried by said rotor and sealingly engaging the adjacent end surfaces.

2. The slant axis rotary mechanism of claim 1 wherein said end surfaces are convex and the sides of said flange are concave.

3. The slant axis rotary mechanism of claim 1 wherein said end surfaces are concave, and the sides of said flange are convex.

4. The slant axis rotary mechanism of claim 1 wherein said housing includes first and second half shells bearing said radially outer spherical surface, said half shells including spaced, radially inwardly opening, peripheral grooves, said housing further including two end wall members defining said end surfaces, the peripheries of said end surfaces being received in a respective one of said grooves, and means securing said half shells together.

5. A slant axis rotary mechanism, comprising:

a housing defining an operating chamber having a radially outer spherical surface, a radially inner spherical surface, and opposed spaced end surfaces extending between said spherical surfaces;

said housing including shell means carrying said outer spherical surface and having spaced, radially inwardly opening grooves flanking said outer spherical surface, and a pair of end wall members each carrying one of said end surfaces and part of said inner spherical surface, the peripheries of said end wall members being disposed in a corresponding one of said grooves;

a shaft journalled in said end wall members and having an angularly offset portion within said chamber; and a rotor within said chamber and journalled on said angularly offset portion.

6. The slant axis rotary mechanism of claim 5 wherein said shell means comprises two half shells and means for securing said shell together.

7. The slant axis rotary mechanism of claim 5 wherein said end surfaces are curved and said rotor has a peripheral flange, the sides of said flange being curved to match said end surfaces.

8. The slant axis rotary mechanism of claim 7 wherein the sides of each of said grooves are substantially in planes transverse to the longitudinal axis of said shaft and each of said end wall members includes a peripheral tongue extending generally transverse to said axis, said tongues being received in corresponding ones of said grooves.

* * * * *